US006110077A

United States Patent [19]

Yu

[11] Patent Number: 6,110,077

[45] Date of Patent: Aug. 29, 2000

[54] FOLDING COLLAPSIBLE JOGGING EXERCISER

[76] Inventor: Jessica Yu, 1F, No. 1. Lane 50, Sec. 1 Chuang-Hsan N. Rd., Yang-Mei Town, Taiwan

[21] Appl. No.: 09/130,231

[22] Filed: Aug. 7, 1998

[51] Int. Cl.[7] ..... A63B 21/00

[52] U.S. Cl. ..... 482/54; 482/51

[58] Field of Search ..... 482/51, 54

[56] References Cited

U.S. PATENT DOCUMENTS 5,718,657 2/1998 Dalebout et al. ..... 482/54

*Primary Examiner*—Glenn E. Richman

*Attorney, Agent, or Firm*—Rosenberg, Klein & Lee

[57] ABSTRACT

A folding collapsible jogging exerciser includes a track unit having a track turned to carry the user who runs on the track, a motor controlled to turn the track, a movable member fixedly fastened to a front side of the track unit outside the track, the movable member holding the motor; a fixed member disposed in front of the movable member, the fixed member having two longitudinally extended sliding slots arranged in parallel at two opposite lateral sides thereof, coupling means fixedly mounted on the movable member and moved along the sliding slots on the fixed member for permitting the track unit to be turned relative to the fixed member between a horizontal position and a vertical position, and a link coupled between an upper front portion of the movable member and a lower rear portion of the fixed member.

3 Claims, 5 Drawing Sheets

FOLDING COLLAPSIBLE JOGGING EXERCISER

BACKGROUND OF THE INVENTION

The present invention relates to a folding collapsible jogging exerciser, and more particularly to such a folding collapsible jogging exerciser which enables the track unit to be maintained in a substantially horizontal position and closely attached to the ground.

FIG. 1 shows a folding collapsible jogging exerciser according to the prior art. This structure of folding collapsible jogging exerciser comprises a rack 13, and a track unit turned about a pivot axis 11 between a horizontal namely the operative position and a vertical namely the collapsed position. When the track unit is set in the operative (horizontal) position, the distance S between the pivot axis 11 and the front edge of the track unit must be smaller than the distance H between the floor and the bottom side wall of the track unit, so that the track unit can be turned about the pivot axis 11 between the horizontal position and the vertical position. However, because the distance H is greater than the distance S, the track unit is suspended above the floor at a height when set in the operative (horizontal) position. The user may feel uncomfortable and unsafe when running on the track of the track unit, which is suspended above the floor at a height.

SUMMARY OF THE INVENTION

The present invention has been accomplished to provide a folding collapsible jogging exerciser which eliminates the aforesaid problem. According to one aspect of the present invention, the folding collapsible jogging exerciser comprises a track unit having a track turned to carry the user who runs on the track, a motor controlled to turn the track, a movable member fixedly fastened to a front side of the track unit outside the track, the movable member holding the motor; a fixed member disposed in front of the movable member, the fixed member having two longitudinally extended sliding slots arranged in parallel at two opposite lateral sides thereof, coupling means fixedly mounted on the movable member and moved along the sliding slots on the fixed member for permitting the track unit to be turned relative to the fixed member between a horizontal position and a vertical position, and a link coupled between an upper front portion of the movable member and a lower rear portion of the fixed member. This arrangement enables the track unit to be closely supported on the floor when it is set in the operative (horizontal) position. According to another aspect of the present invention, two wheel holder assemblies are respectively fixedly connected to two opposite ends of the coupling rod for supporting the movement of the coupling rod along the sliding slots.

DETAILED DESCRIPTION OF THE PREFERRED EMBODIMENT

Figure 1:
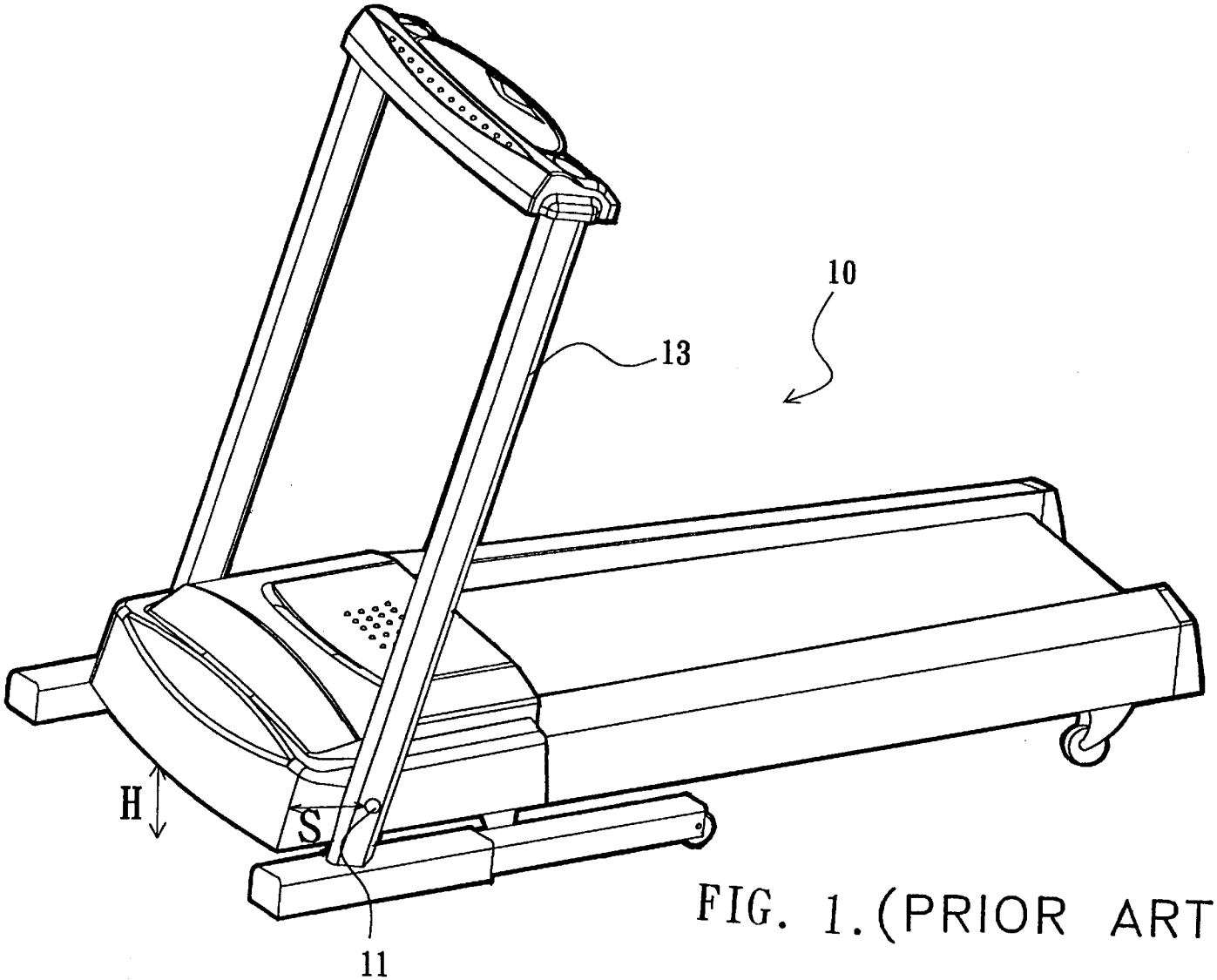
FIG. 1. (PRIOR ART)
FIG. 1 is a perspective view of a folding collapsible jogging exerciser according to the prior art.
Figure 2:
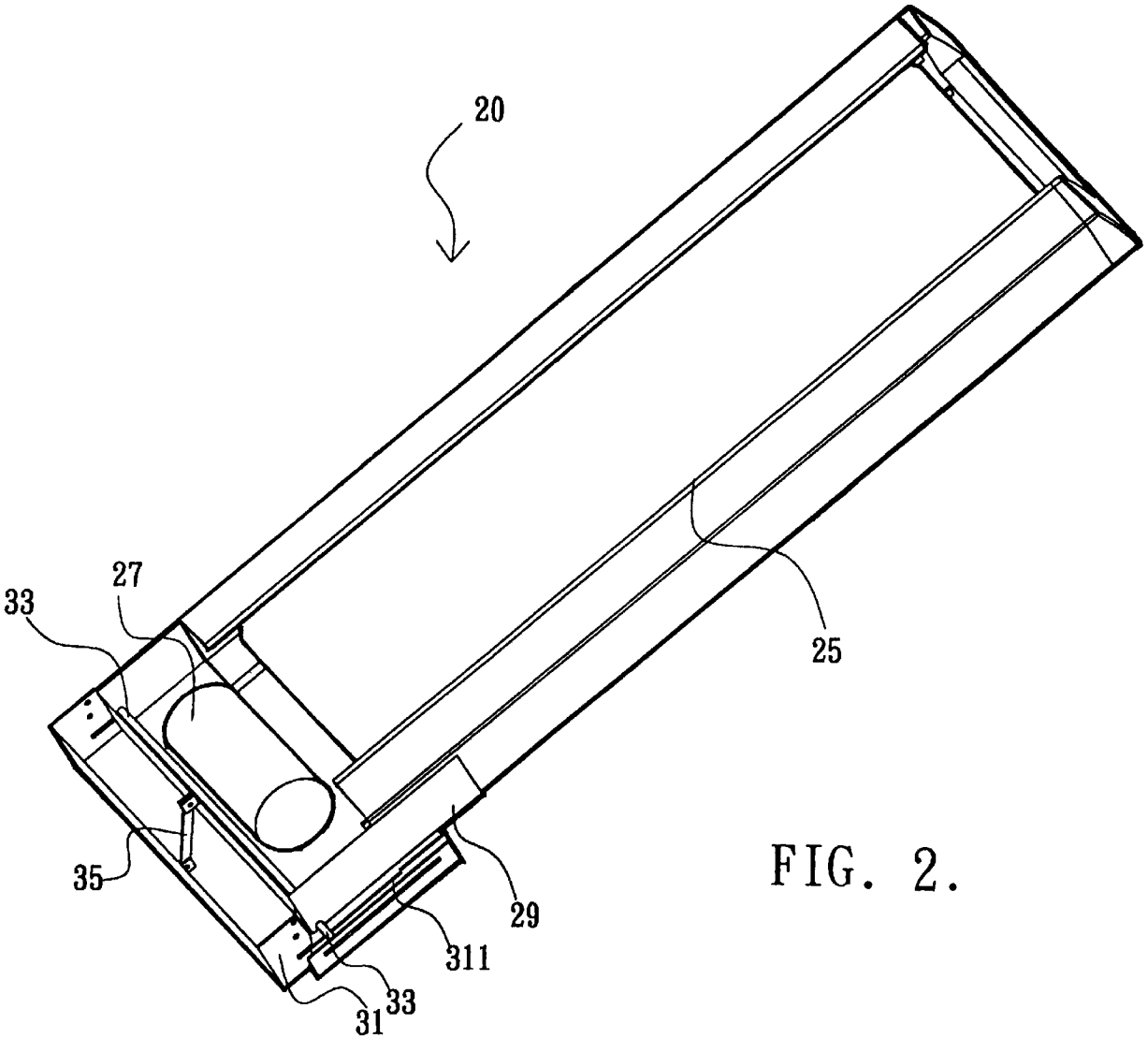
FIG. 2 is a schematic drawing of the present invention, showing the internal structure of the folding collapsible jogging exerciser and the track unit set in the horizontal position (the rack excluded).

Referring to FIG. 2, a folding collapsible jogging exerciser 20 in accordance with the present invention is generally comprised of a track unit 25, a motor 27, a movable member 29, a fixed member 31, a coupling rod 33, and a link 35. The motor 27 is controlled to turn the track of the track unit 25, and to lift the jogging exerciser 20 to a sloping position. The movable member 29 is fixedly connected to the frame of the track unit 25 to hold the motor 27. The fixed member 31 is provided in front of the movable member 29, having two sliding slots 311 longitudinally arranged in parallel at two opposite lateral sides thereof. The coupling rod 33 is fixedly mounted on the movable member 29, and moved along the sliding slots 311. The link 35 is coupled between an upper front portion of the movable member 29 and a lower rear portion of the fixed member 31. When collapsing the jogging exerciser 20, the track unit 25 and the movable member 29 are turned upwards from a horizontal position (see FIG. 2) to a vertical position (see FIG. 5) and at the same time the link 35 is turned from a vertical position (see FIG. 2) to a horizontal position (see FIG. 5) to constantly keep the movable member 29 away from the fixed member 31 at a distance.

Figure 3:
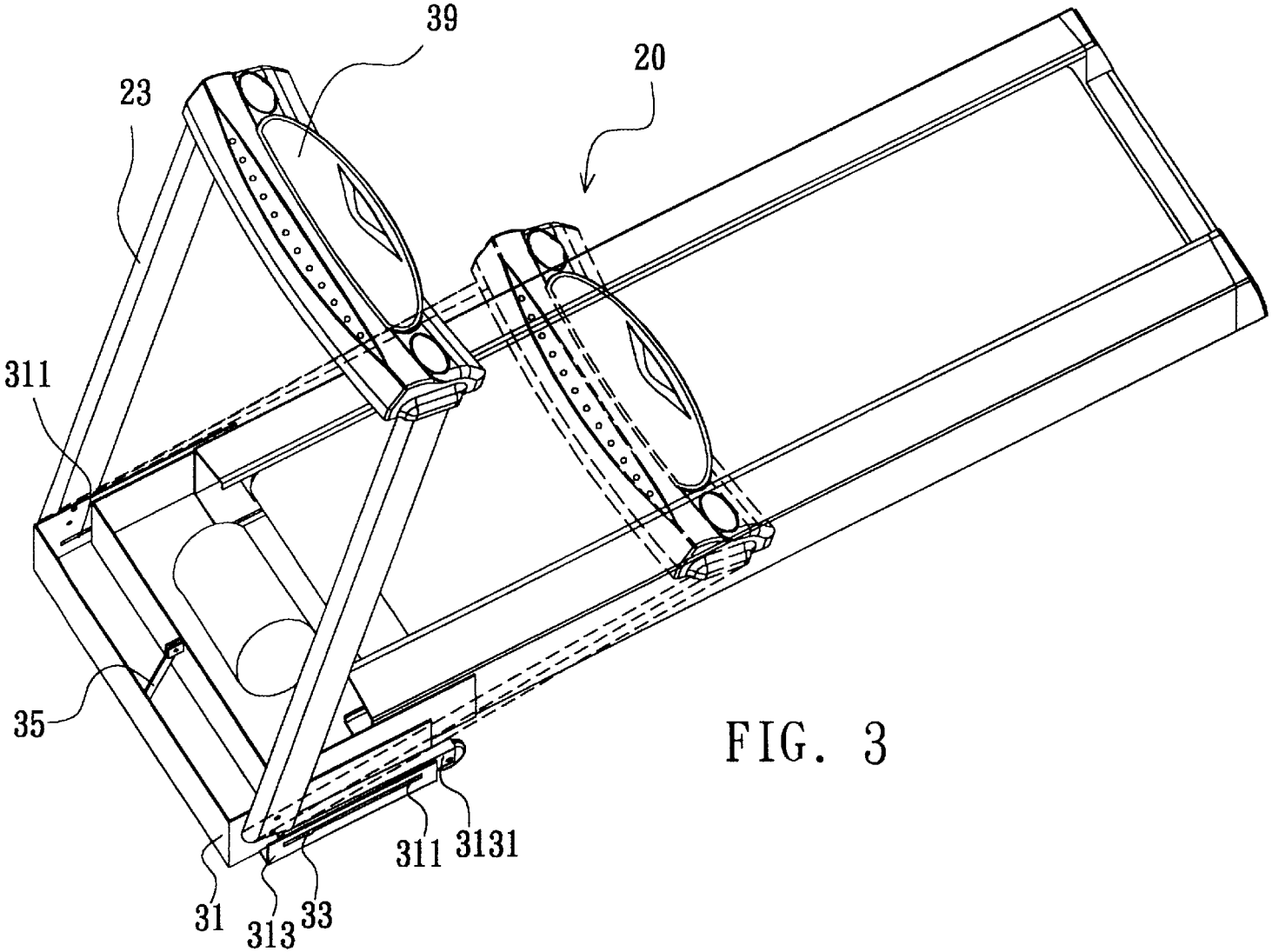
FIG. 3 is a schematic drawing of the present invention, showing the rack turned between the horizontal position and the vertical position.
Figure 4:
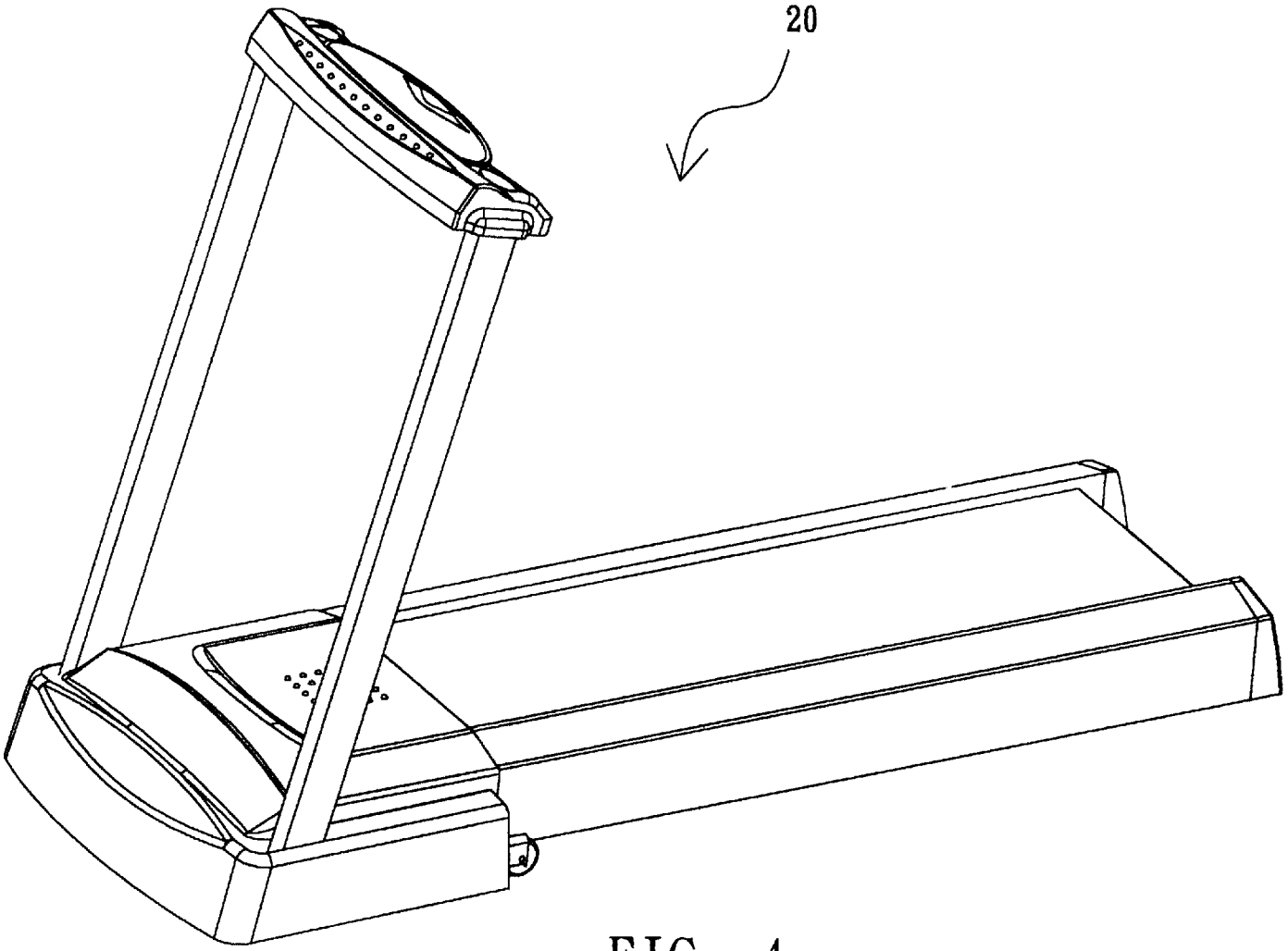
FIG. 4 is a perspective view of the present invention, showing the track unit set in horizontal.

Referring to FIG. 3, the fixed member 31 further comprises two sliding ways 313 respectively arranged in parallel to the sliding slots 311. Two wheel holder assemblies 3131 are respectively fixedly connected to two opposite ends of the coupling rod 33, and moved with the coupling rod 33 along the sliding ways 313. The wheel holder assemblies 3131, each are comprised of a wheel holder and at least one rollers mounted on the wheel holder. Because the coupling rod 33 is supported on the rollers of the wheel holder assemblies 3131, the coupling rod 33 can be stably smoothly moved back and forth along the sliding slots 311. Further, a rack 23 is raised from the fixed member 31, and a control panel 39 is mounted on the rack 23 at the top. The control panel 39 controls the operation of the folding collapsible jogging exerciser 20. The rack 23 is pivoted to the fixed member 31, and releasably locked by a lock (not shown). When the lock is unlocked, the rack 23 can be turned downwards from a vertical position to a horizontal position.

Figure 5:
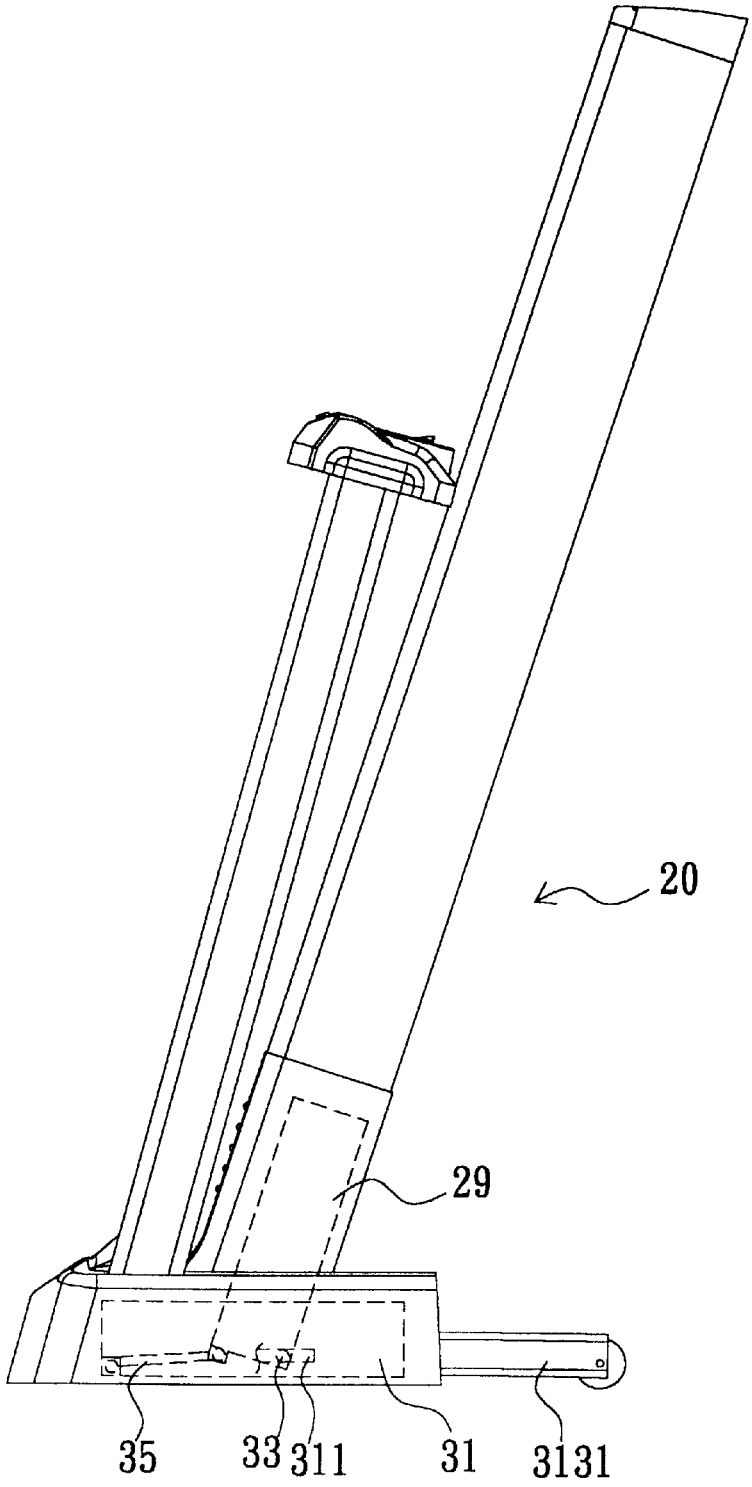
FIG. 5 shows the folding collapsible jogging exerciser collapsed according to the present invention.

Referring to FIG. 5 and FIG. 3 again, when the track unit 25 is turned between the horizontal position shown in FIG. 3 and the horizontal position shown in FIG. 5, the coupling rod 33 is moved with the movable member 29 along the sliding slots 311 on the fixed member 31, and the wheel holder assemblies 3131 are moved with the coupling rod 33 in and out of the sliding ways 313.

While only one embodiment of the present invention has been shown and described, it will be understood that various modifications and changes could be made thereunto without departing from the spirit and scope of the invention disclosed.

What the invention claimed is:

1. A folding collapsible jogging exerciser comprising:

a track unit having a track turned to carry the user who runs on said track;

a motor controlled to turn said track;

a movable member fixedly fastened to a front side of said track unit outside said track, said movable member holding said motor;

a fixed member disposed in front of said movable member, said fixed member having two longitudinally extended sliding slots arranged in parallel at two opposite lateral sides thereof;

at least one coupling rod fixedly mounted on two sides of front end of said movable member and moved along said sliding slots on said fixed member for permitting said track unit to be turned relative to said fixed member between a horizontal position and a vertical position; and at least one link coupled between an upper front portion of said movable member and a lower rear portion of said fixed member.

2. A folding collapsible jogging exerciser comprising:

a track unit having a track turned to carry the user who runs on said track;

a motor controlled to turn said track;

a movable member fixedly fastened to a front side of said track unit outside said track, said movable member holding said motor;

a fixed member disposed in front of said movable member, said fixed member having two longitudinally extended sliding slots arranged in parallel at two opposite lateral sides thereof;

at least one coupling rod fixedly mounted on two sides of front end of said movable member and moved along said sliding slots on said fixed member for permitting said track unit to be turned relative to said fixed member between a horizontal position and a vertical position;

at least one link coupled between an upper front portion of said movable member and a lower rear portion of said fixed member; and two wheel holder assemblies having at least one roller are respectively fixedly connected to two opposite ends of said coupling rod and moved with said coupling rod.

3. The folding collapsible jogging exerciser of claim 2 wherein said fixed member comprises two sliding ways respectively arranged in parallel to said sliding slots thereof in which said wheel holder assemblies are moved with said coupling rod along said sliding ways.

* * * * *